US008681066B2

(12) United States Patent
Brandau et al.

(10) Patent No.: US 8,681,066 B2
(45) Date of Patent: Mar. 25, 2014

(54) MONOLITHIC MICROWAVE ANTENNA FEED AND METHOD OF MANUFACTURE

(75) Inventors: Ronald J Brandau, Homer Glen, IL (US); Haidong Chen, Nanjing (CN); Li Zhang, Suzhou (CN)

(73) Assignee: Andrew LLC, Hickory, NC (US)

( * ) Notice: Subject to any disclaimer, the term of this patent is extended or adjusted under 35 U.S.C. 154(b) by 341 days.

(21) Appl. No.: 13/257,226

(22) PCT Filed: Mar. 12, 2010

(86) PCT No.: PCT/US2010/027166

§ 371 (c)(1), (2), (4) Date: Sep. 16, 2011

(87) PCT Pub. No.: WO2010/123634

PCT Pub. Date: Oct. 28, 2010

(65) Prior Publication Data

US 2012/0007792 A1 Jan. 12, 2012

(30) Foreign Application Priority Data

Apr. 23, 2009 (CN) ..... 2009 1 0141928

(51) Int. Cl.
*H01Q 1/00* (2006.01)

(52) U.S. Cl.
CPC ..... *H01Q 1/00* (2013.01); *H01Q 13/65* (2013.01); *H01Q 13/208* (2013.01)
USPC ..... 343/772; 343/786

(58) Field of Classification Search
CPC ..... H01Q 13/0258; H01Q 13/065; H01Q 13/0208
USPC ..... 343/786, 772, 907
See application file for complete search history.

(56) References Cited

U.S. PATENT DOCUMENTS

| | | | | |
|---|---|---|---|---|
| 3,435,380 | A | 3/1969 | Billon et al. | |
| 3,864,688 | A | 2/1975 | Hansen et al. | |
| 5,041,840 | A * | 8/1991 | Cipolla et al. | 343/725 |
| 5,767,815 | A * | 6/1998 | Krebs | 343/786 |

(Continued)

FOREIGN PATENT DOCUMENTS

| | | |
|---|---|---|
| GB | 962601 | 7/1964 |
| GB | 1219872 | 1/1971 |
| WO | 2005114791 | 1/2005 |
| WO | 2009031794 | 3/2009 |

OTHER PUBLICATIONS

Simin Baharlou, International Preliminary Report on Patentability, parent PCT application: PCT/US2010/027166, issued Oct. 25, 2011, The International Bureau of WIPO, Geneva, Switzerland.

*Primary Examiner* — Hoanganh Le
(74) *Attorney, Agent, or Firm* — Babcock IP, PLLC

(57) ABSTRACT

A microwave antenna feed arrangement provided with a unitary body with a feed bore between a launch end and a back end of the body. A plurality of coaxial annular grooves are located on the launch end of the body. An OMT bore in the body extends from a side of the body to the feed bore. The body may be further configured with an end cap to close the back end of the feed bore or a feed elbow for dual polarization operation. The body may be manufactured for example, by machining or metal injection molding.

18 Claims, 11 Drawing Sheets

(56) References Cited

U.S. PATENT DOCUMENTS

| | | | | |
|---|---|---|---|---|
| 6,087,908 | A | 7/2000 | Haller et al. | |
| 6,166,699 | A | 12/2000 | Khammouni et al. | |
| 6,297,710 | B1 * | 10/2001 | Cook et al. | 333/21 A |
| 6,529,098 | B2 | 3/2003 | Moheb | |
| 6,621,375 | B2 | 9/2003 | Vezmar et al. | |
| 6,661,309 | B2 | 12/2003 | Chen et al. | |
| 6,677,911 | B2 | 1/2004 | Moheb | |
| 6,720,932 | B1 * | 4/2004 | Flynn et al. | 343/786 |
| 6,842,085 | B2 | 1/2005 | Chen et al. | |
| 7,236,681 | B2 | 6/2007 | Moheb et al. | |

* cited by examiner

MONOLITHIC MICROWAVE ANTENNA FEED AND METHOD OF MANUFACTURE

BACKGROUND

1. Field of the Invention

This invention relates to microwave reflector antennas. More particularly, the invention relates to a feed arrangement configurable for multiple feed configurations without tuning.

2. Description of Related Art

Microwave reflector antennas use a feed arrangement to launch and/or receive RF signal(s) from an RF source/receiver. The feed arrangement typically comprises a feed horn/illuminator plate launching the signal(s) with a desired feed pattern, for example with minimal back lobes, and an ortho mode transducer (OMT) for separating one or more polarities of the signal(s) into separate waveguides coupled to a desired receiver and/or transmitter.

Prior feed arrangements, for example as shown in FIG. 1, are typically frequency and polarity specific, hand tuned via a plurality of adjustment screws and shorting pins arranged in the feed bore. Each of the screws, pins, end cap and illuminator plate are manually soldered in place to both permanently fix each of the tuning elements in its selected placement after bench tuning and environmentally seal the numerous pathways into the feed bore created by the supporting apertures of each of the tuning elements. Assembly for tuning, manual tuning, soldering and subsequent disassembly to clean soldering flux from the assembly significantly increases the number of required manufacturing steps as well as the training and dedication requirements for manufacturing labor. Further, the large number of discrete elements increases manufacturing overhead for the separate procurement, inventory and timely delivery of each element to the point of assembly.

Competition in the reflector antenna market has focused attention on improving long-term electrical performance and minimization of overall manufacturing costs. Therefore, it is an object of the invention to provide a feed arrangement that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
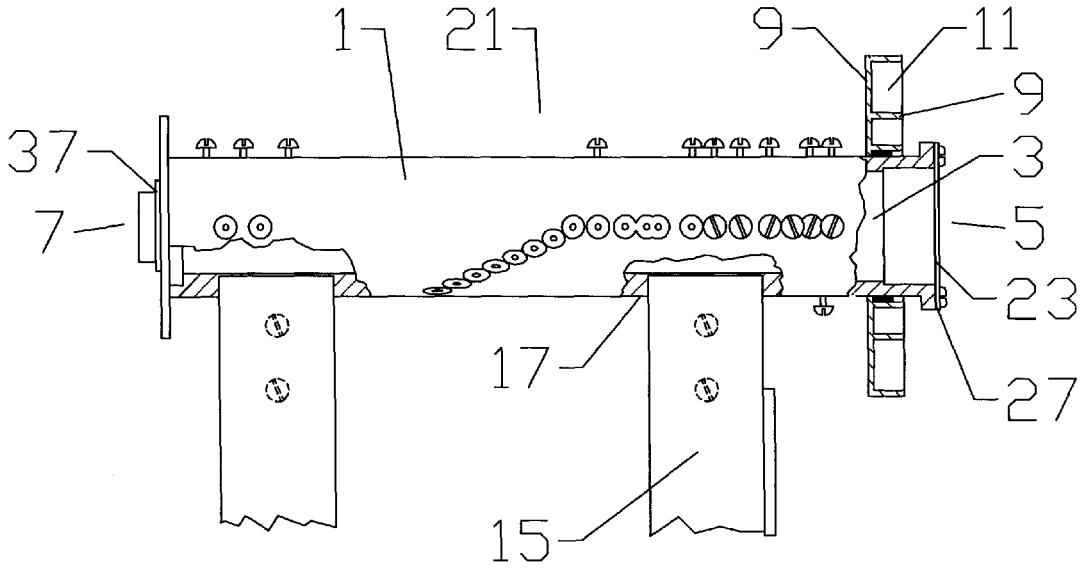
Fig. 1 Prior Art
FIG. 1 is a schematic partial cut-away side view of an exemplary prior art dual polarization feed arrangement.

By providing a unitary monolithic body configured to receive simplified attachments, a microwave antenna feed arrangement configurable for multiple microwave antenna applications may be manufactured with significant manufacturing efficiencies.

As shown for example in FIGS. 2-6, a unitary body 1 has a feed bore 3 between a launch end 5 and a back end 7.

One skilled in the art will appreciate that the launch end 5 and back end 7 are descriptors used herein to clarify longitudinal locations and contacting interrelationships between the various elements of the feed arrangement 21. In addition to the identified positions in relation to adjacent elements along the feed arrangement 21 longitudinal axis, each individual element has a launch end 5 side and a back end 7 side, i.e. the sides of the respective element that are facing the respective launch end 5 and the back end 7 of the feed arrangement 21.

Figure 2:
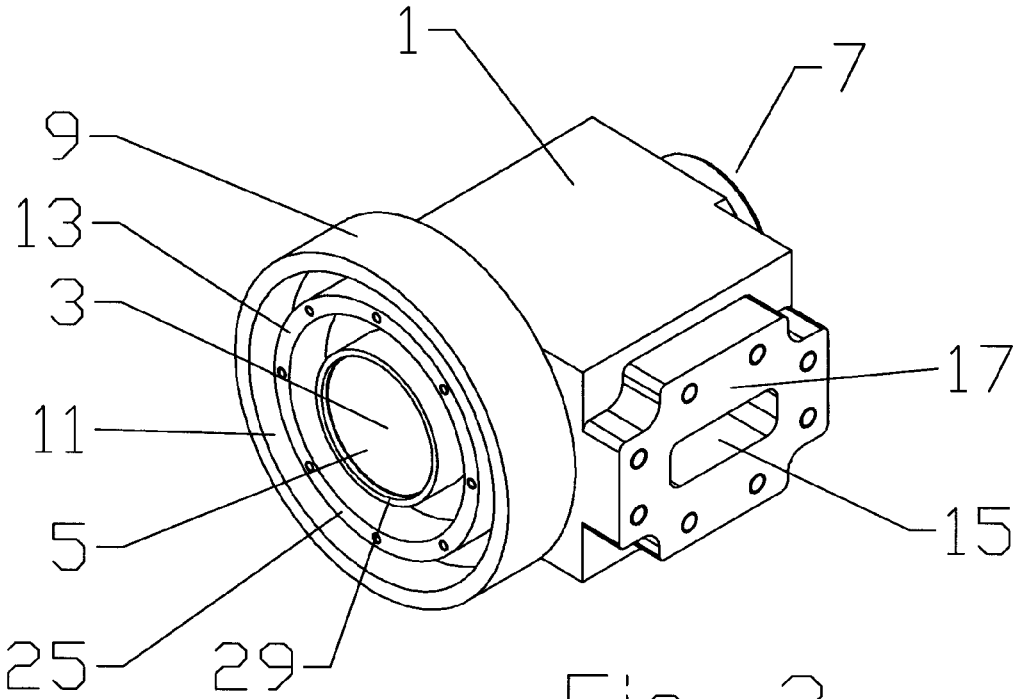
FIG. 2 is a schematic isometric angled launch end view of an antenna feed body.
Figure 3:
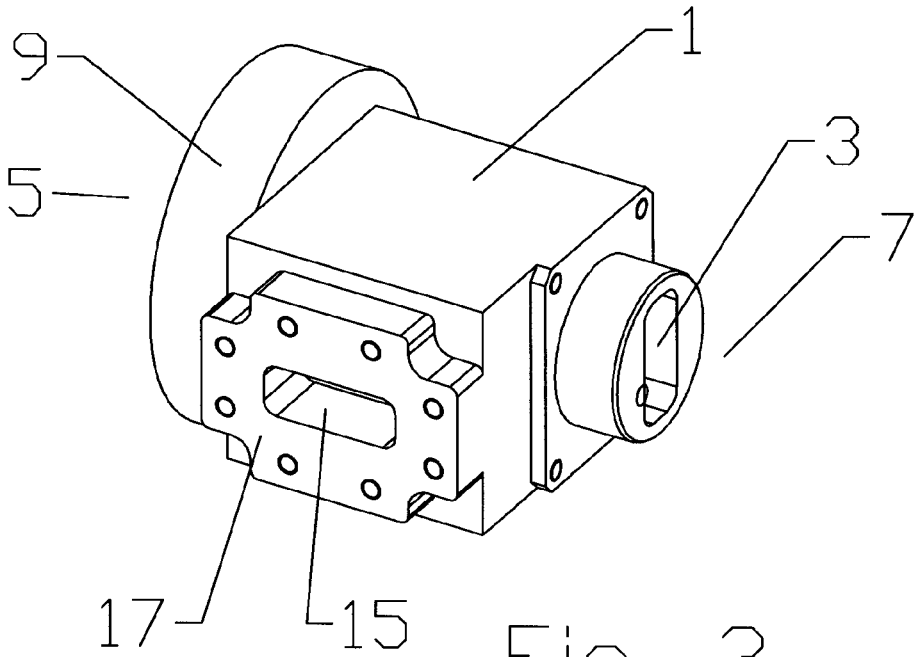
FIG. 3 is a schematic isometric angled back end view of the antenna feed body of FIG. 2.
Figure 4:
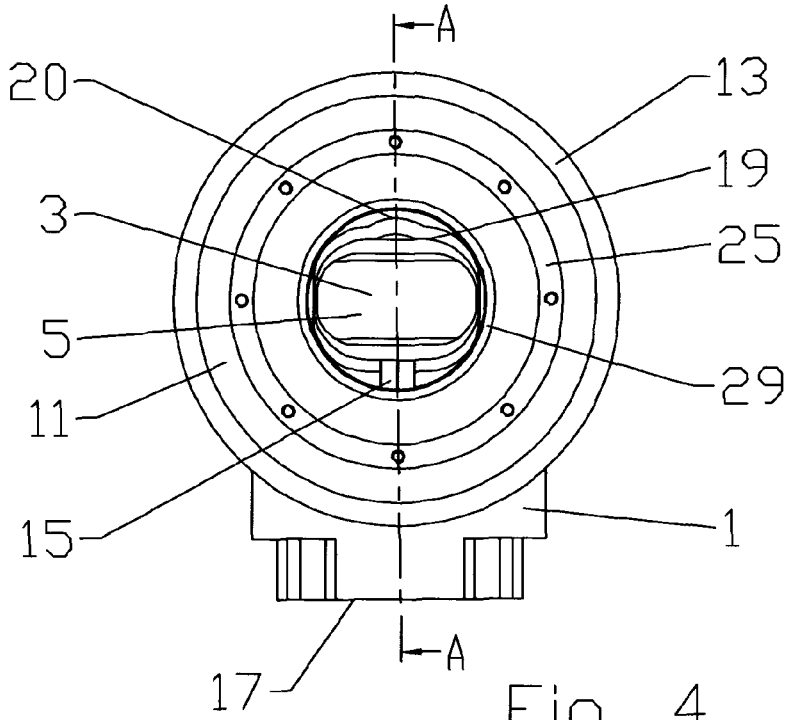
FIG. 4 is a schematic launch end view of the antenna feed body of FIG. 2.
Figure 5:
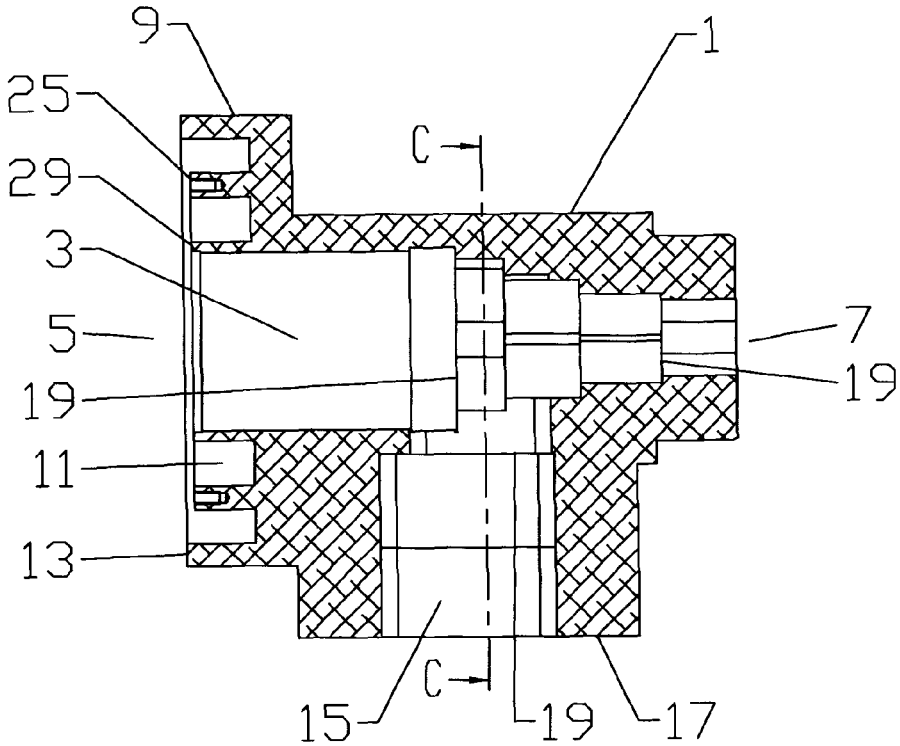
FIG. 5 is a schematic cross-section view of the antenna feed body of FIG. 2, along line A-A of FIG. 4.
Figure 6:
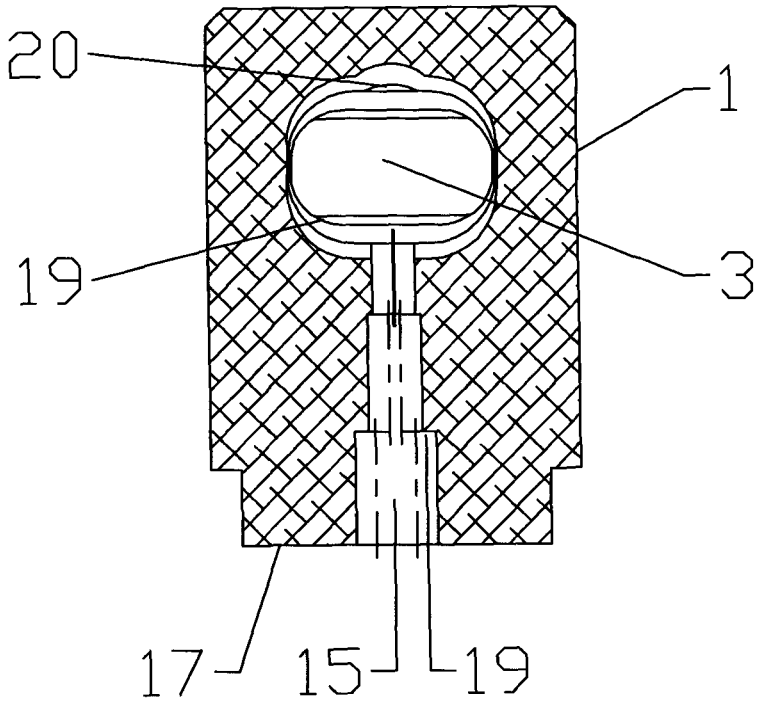
FIG. 6 is schematic cross-section view of the antenna feed body of FIG. 2, along line C-C of FIG. 5.
Figure 7:
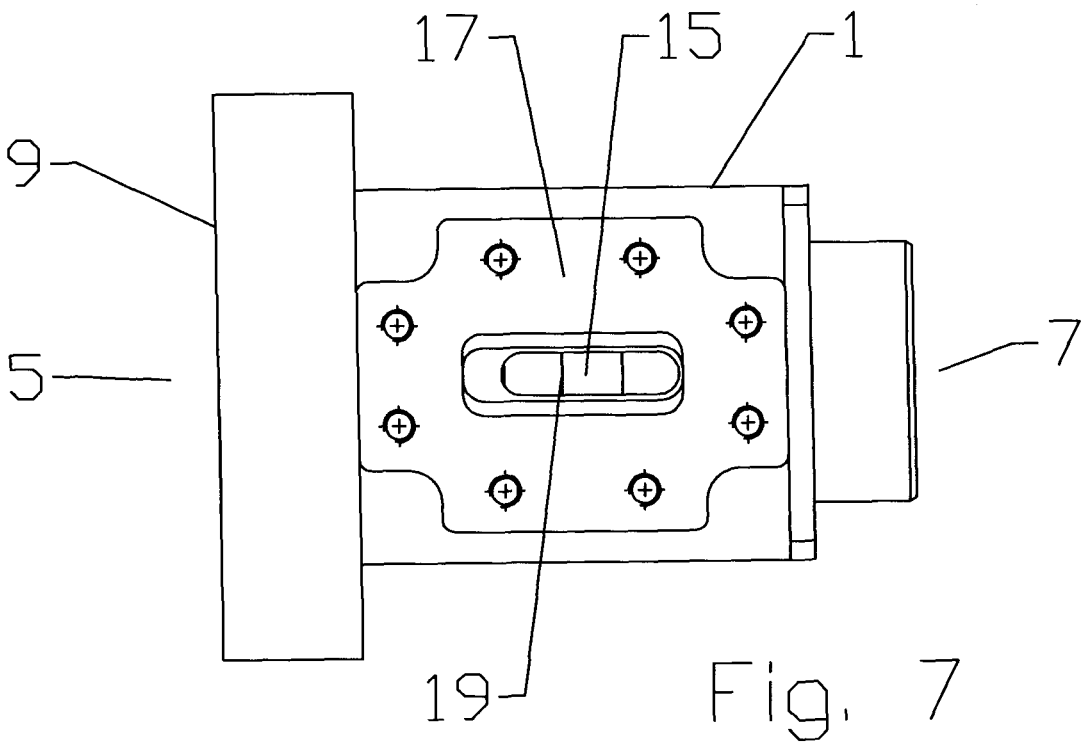
FIG. 7 is a schematic side view of the antenna feed body of FIG. 2.

As best shown in FIGS. 2 and 3, an illuminator plate 9 is formed by providing a plurality of coaxial annular groove(s) 11 on the launch end 5 of the body 1, the annular groove(s) 11 forming corrugations 13 open to the launch end 5. As best shown in FIGS. 4-7, an OMT bore 15 extends from a side 17 of the body 1 to the feed bore 3, oriented, for example, normal to the feed bore 3.

The feed bore 3 and the OMT bore 15 are each provided with a plurality of inward projecting shoulder(s) 19 (FIG. 4) to transition between desired inlet and outlet bore cross sections. For example, via the inward projecting shoulder(s) 19, the feed bore 3 may transition between a circular cross section at the launch end 5 to a generally rectangular cross section at the back end 7. A pseudo balance feature may be added to the feed bore 3 configuration by including radius feature(s) 20 to the inward projecting shoulder(s) 19 opposite the OMT bore 15 intersection with the feed bore 3, best shown in FIGS. 4 and 6, to reduce the propagation of undesired higher order mode energy otherwise enabled by the unbalanced nature of the region due to the addition of the OMT bore. Similarly, inward projecting shoulder(s) 19 applied to the OMT bore 15 may transition to a rectangular cross section with an increased length and/or width from the feed bore 3 to the side 17 of the body 1. Contour, spacing and/or step size of the inward projecting shoulder(s) 19 may be calculated with respect to the proximity to the OMT bore 15 intersection with the feed bore 3 and/or a desired operating band of the resulting feed arrangement 21.

Figure 8:
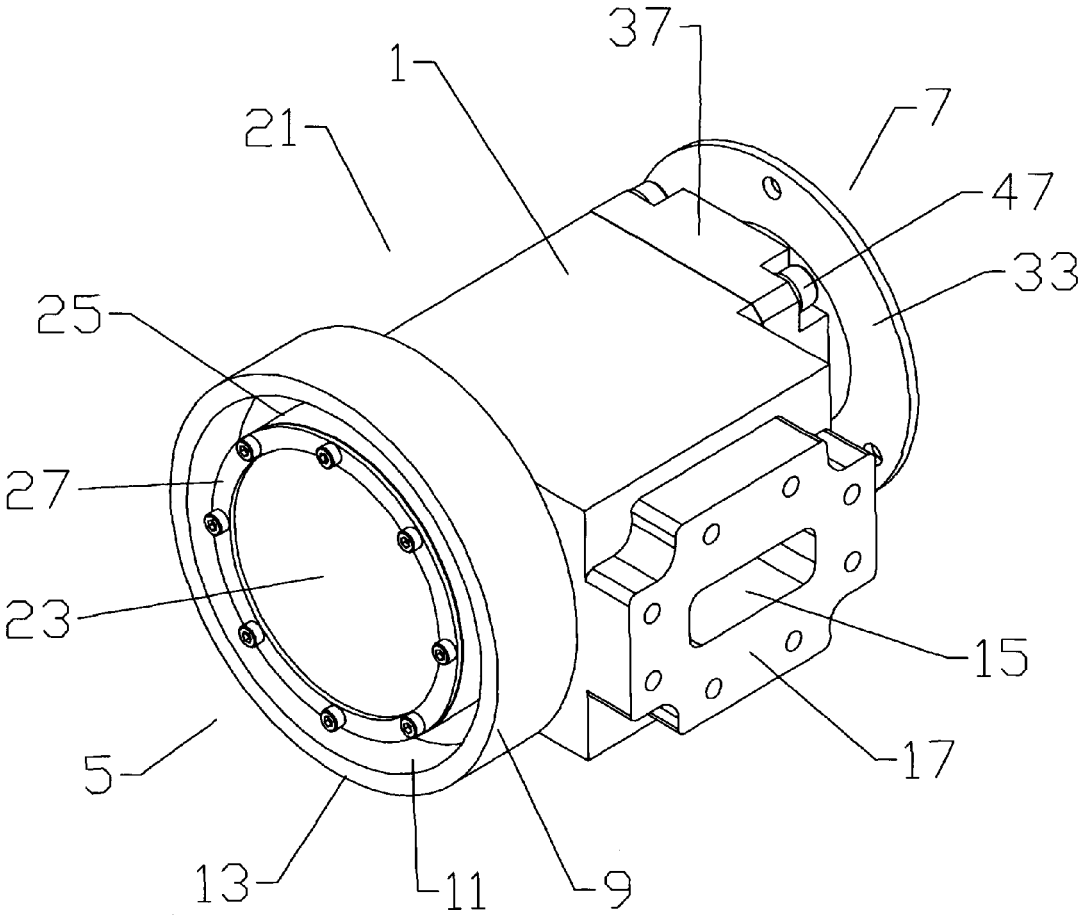
FIG. 8 is a schematic isometric angled launch end view of a feed arrangement configured for single polarity operation.
Figure 9:
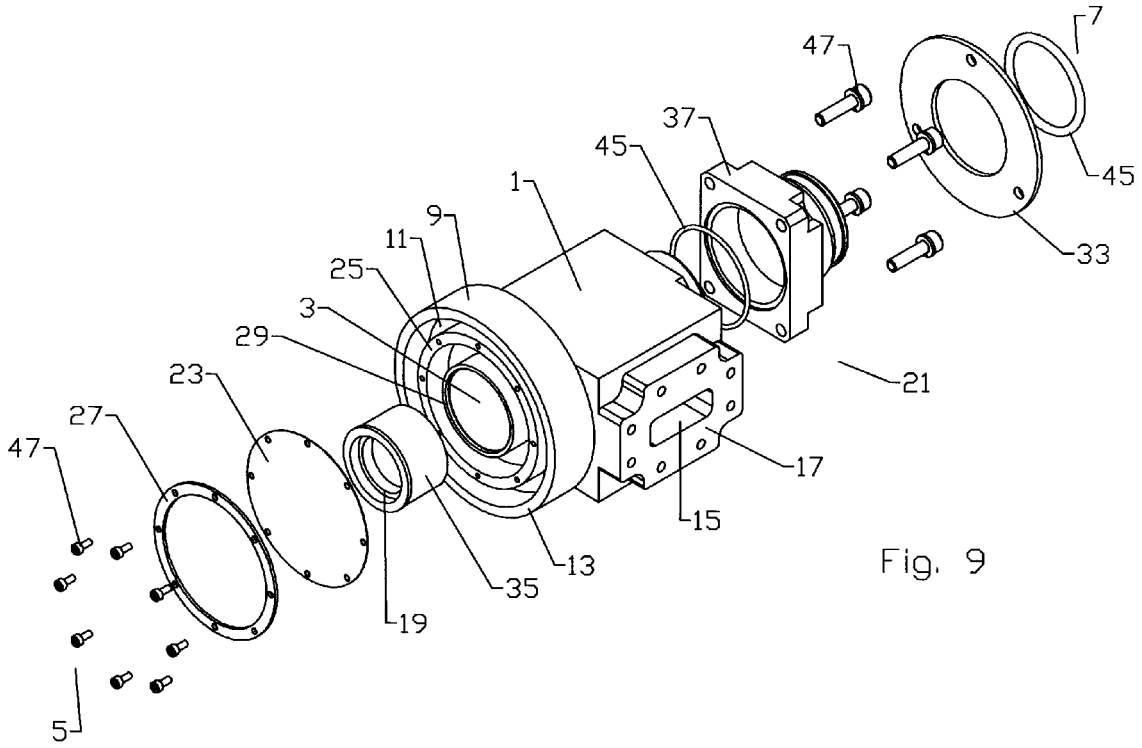
FIG. 9 is a schematic isometric exploded view of FIG. 8.
Figure 10:
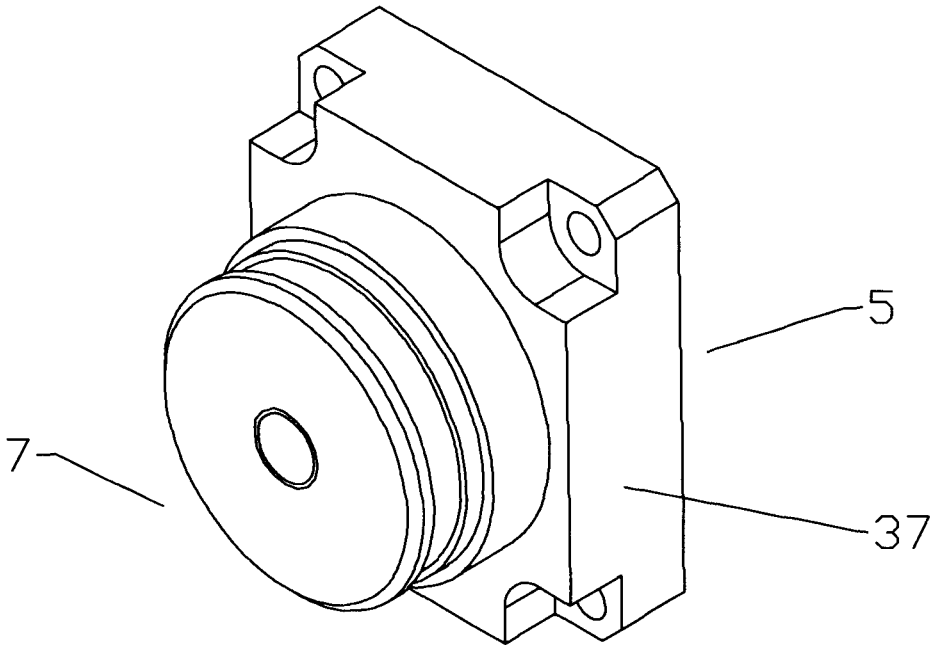
FIG. 10 is a schematic isometric angled back end view of the end cap of FIG. 8.
Figure 11:
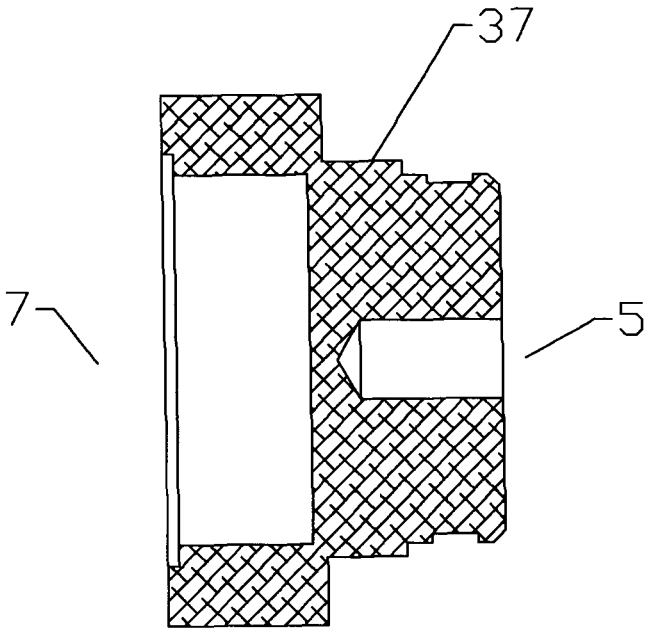
FIG. 11 is a schematic cross-section side view of the end cap of FIG. 8.

As shown in FIG. 8, the launch end 5 of the body 1 may be environmentally sealed by applying a window of dielectric material to seal the launch end 5 of the feed bore 3. The window 23 may be coupled, for example, to a second corrugation peak 25 of the annular groove(s) 11 by an iris 27. A height of the first corrugation 29 and the second corrugation 25 may be adjusted so that when the window 23 is applied, the iris 27, for example formed as a separate metallic ring or alternatively as a metalized ring applied to the periphery of the window 23, is flush with the remainder of corrugation(s) 13. Further, a guy ring 33 (see FIG. 9) may be applied to the back end 7 of the feed arrangement 21 for attaching guy wires for support and/or stabilization of the feed with respect to the antenna reflector.

A matching ring 35, for example formed from a dielectric material, may be seated within the feed bore 3, inserted from the launch end 5. Optimizing of the feed arrangement 21 may be significantly simplified by exchanging between multiple matching ring(s) 35 provided with a dielectric material, thickness, diameter and/or inward projecting shoulder(s) 19 configured to match with a desired operating frequency and/or any corresponding impedance discontinuities, for example generated by the presence of the window 23.

Where the feed arrangement 21 will be operated with respect to a single polarity, such as in a receive only configuration, the feed bore 3 may be closed at the back end by coupling an end cap 37 to the back end 7 of the body 1, closing the feed bore 3, for example as shown in FIGS. 8-11.

Figure 12:
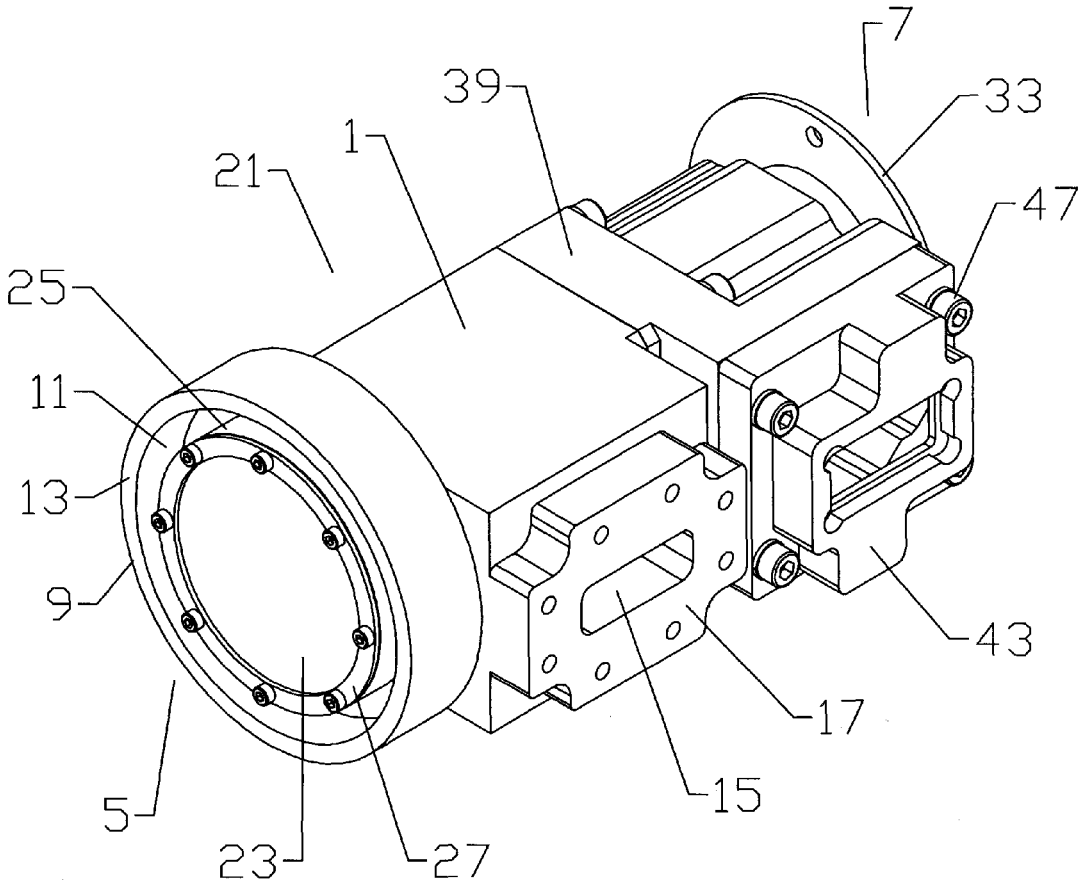
FIG. 12 is a schematic isometric angled launch end view of a feed arrangement configured for dual polarity operation.
Figure 13:
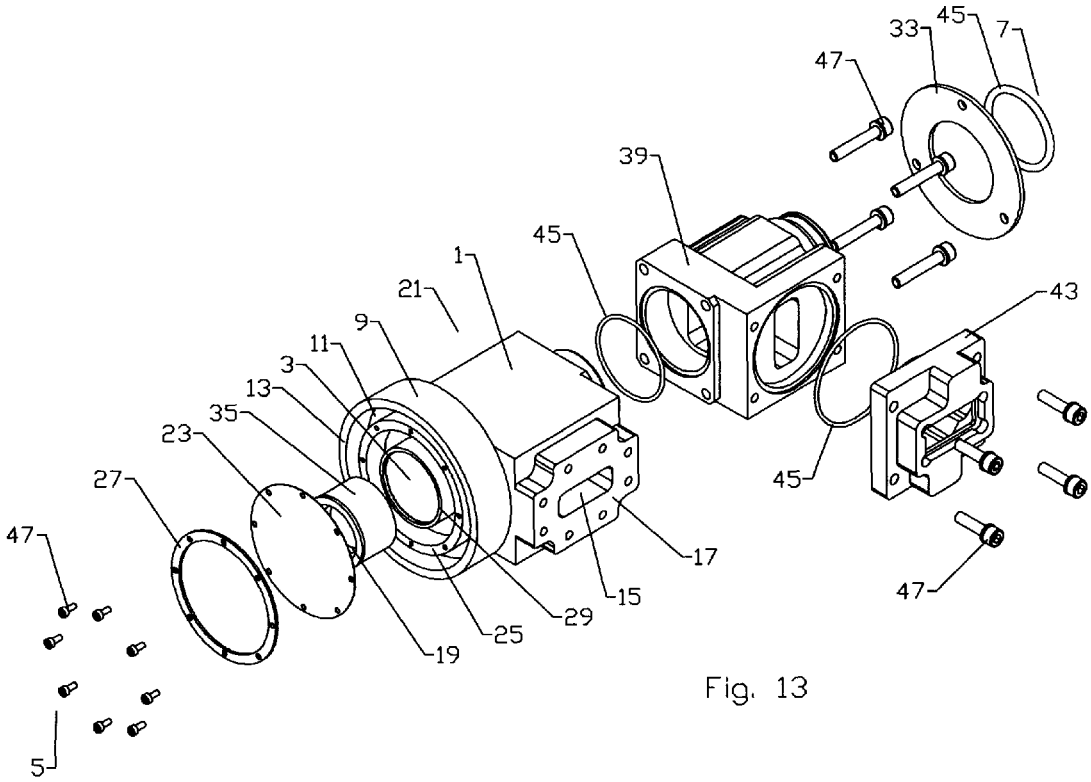
FIG. 13 is a schematic isometric exploded view of FIG. 12.
Figure 14:
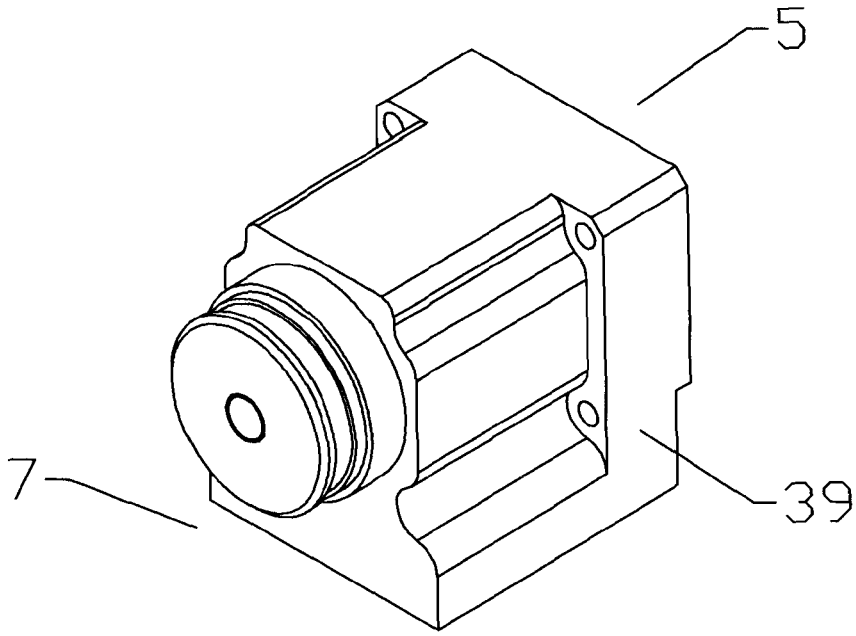
FIG. 14 is a schematic isometric angled back end view of the feed elbow of FIG. 12.
Figure 15:
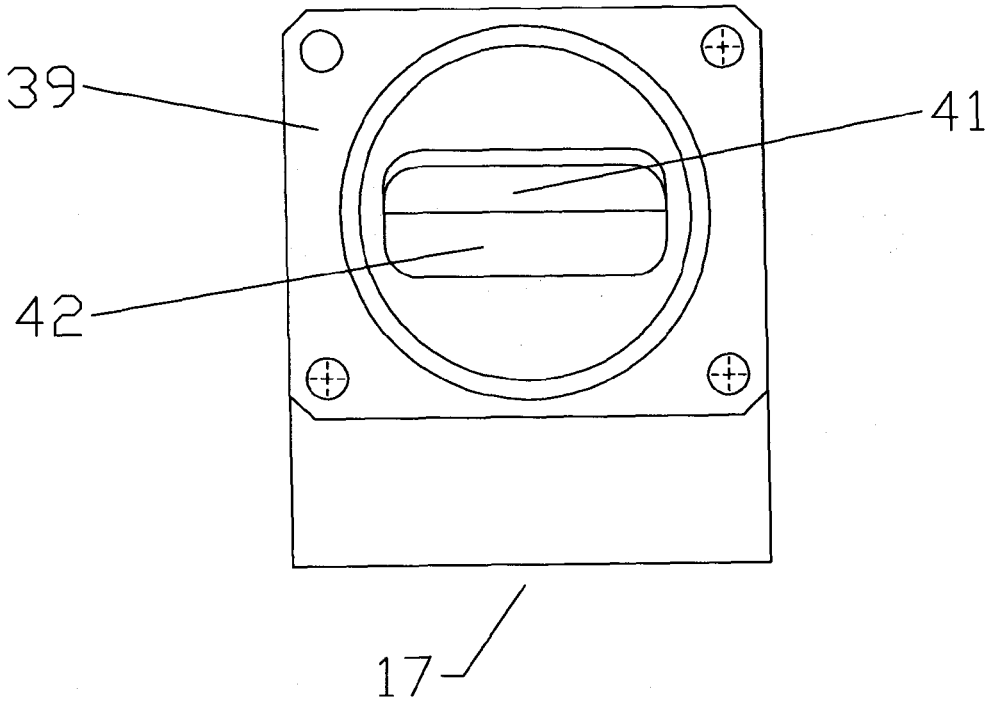
FIG. 15 is a schematic launch end view of the feed elbow of FIG. 12.
Figure 16:
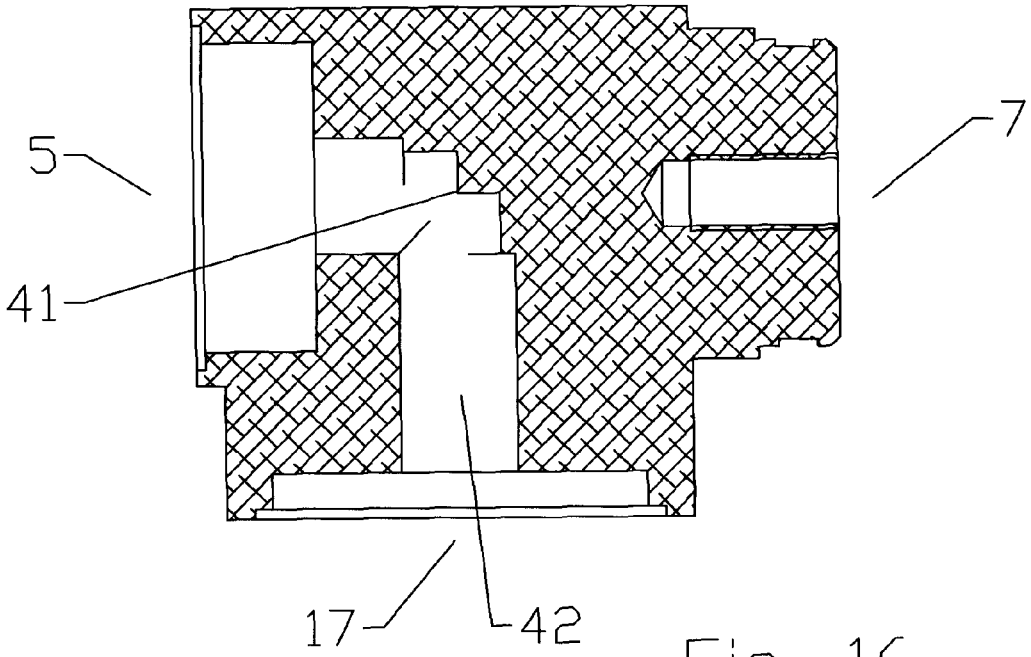
FIG. 16 is a schematic cross-section view of the feed elbow of FIG. 12.
Figure 17:
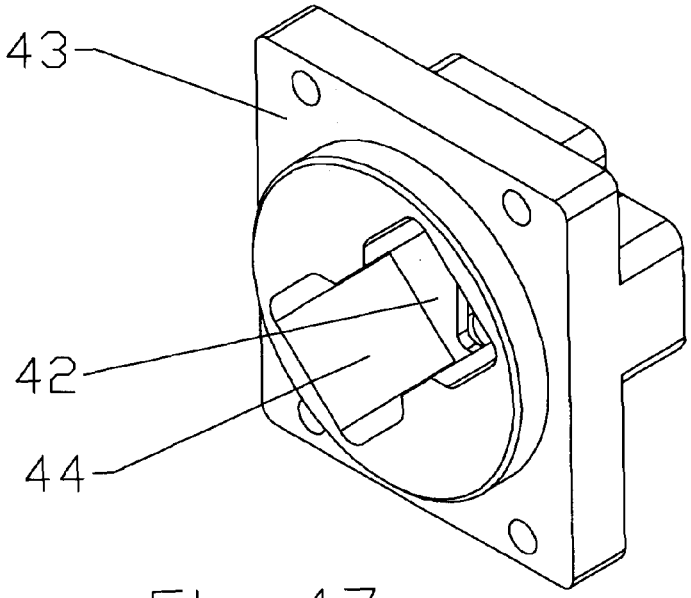
FIG. 17 is a schematic angled isometric view of the feed rotator of FIG. 12.

For dual polarity operation, a signal connection may be made to the back end 7 of the body 1 coaxial with the feed bore 3. To minimize blockage of the antenna reflector (not shown), the feed waveguides (not shown) coupled to the feed arrangement 21 may be arranged in-line with one another along the longitudinal axis of the body 1. For example, as shown in FIGS. 12 and 13, a feed elbow 39 may be coupled to the back end 7 of the body 1. The feed elbow 39 is formed with an elbow bore 41 extending from a launch end 5 of the feed elbow 39 through, for example, a 90 degree transition formed by a plurality of step(s) 42 to a side 17 of the feed elbow 39 as best shown in FIGS. 14-16. To further align rectangular feed waveguides parallel to one another for minimum blockage of the reflector antenna, a feed rotator 43 (FIG. 17) with a feed rotator bore 44 configured with step(s) 42 adjusting the angle of the waveguide path through the feed rotator bore 45 may be coupled to the side 17 of the feed elbow 39, for example rotating the orientation of the waveguide path from the side 17 of the feed elbow 39 by 90 degrees.

One skilled in the art will appreciate that the feed arrangement 21 may be entirely pre-tuned by the manufacturing tolerances applied to the formation of the feed and OMT bores 3,15. In modeled and measured performance, the feed arrangement 21 has been demonstrated with frequency bandwidth of 18.4% and greater than 30 dB return loss and 45 dB open and short circuit isolations.

Further, because the body 1 is unitary monolithic element, the feed arrangement 21 may be environmentally sealed by application of the window 23 and any gasket(s) 45 such as o-rings located at the interconnection(s) between the body 1 and the end cap 37 or feed elbow 39 and rotation rotator 43, if any. Thereby, the desired feed arrangement 21 may be securely RF and environmentally sealed without requiring any soldering manufacturing steps, whatsoever.

The body 1, end cap 37, feed elbow 39 and feed rotator 43 may each be configured without internal overhanging edges with respect to the feed bore 3 and/or OMT bore 15 enabling greatly simplified manufacture of these components via, for example, two-axis CNC machining and/or metal injection molding. For metal injection molding, a slight taper may be added to the various mold separation surfaces to simplify mold separation. Because the same body 1 may be used with single and dual polarity feed arrangement(s) 21 design, manufacturing set-up and product inventory requirements may be reduced. Further, because the assembly steps require only the mounting of self aligning elements upon one another and, for example, the threading of a handful of fastener(s) 47 to secure same in place, assembly may be performed by cost effective labor with reduced skill levels and/or training requirements.

Table of Parts

| | |
|---|---|
| 1 | body |
| 3 | feed bore |
| 5 | launch end |
| 7 | back end |
| 9 | illuminator plate |
| 11 | annular groove |
| 13 | corrugation |
| 15 | OMT bore |
| 17 | side |
| 19 | inward projecting shoulder |
| 20 | radius feature |
| 21 | feed arrangement |
| 23 | window |
| 25 | second corrugation |
| 27 | iris |
| 29 | first corrugation |
| 33 | guy ring |
| 35 | matching ring |
| 37 | end cap |
| 39 | feed elbow |
| 41 | elbow bore |
| 42 | step |
| 43 | feed rotator |
| 44 | feed rotator bore |
| 45 | gasket |
| 47 | fastener |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A microwave antenna feed arrangement, comprising:

a monolithic body with a feed bore between a launch end and a back end of the body;

the feed bore provided with a plurality of inward projecting shoulders that transition the feed bore from a circular cross section at the launch end to a generally rectangular cross-section at the back end;

a plurality of coaxial annular grooves on the launch end of the body, coaxial with the feed bore;

an ortho mode transducer bore in the body extending through the body to the feed bore.

2. The feed arrangement of claim 1, further including an end cap at the back end of the body; the end cap covering the feed bore.

3. The feed arrangement of claim 1, further including a feed elbow coupled to the back end of the body; the feed elbow provided with an elbow bore extending from a launch end of the feed elbow to a side of the elbow normal to the launch end.

4. The feed arrangement of claim 3, further including a feed rotator coupled to the side of the feed elbow, a feed rotator bore of the feed rotator operative to rotate an orientation of the feed rotator bore 90 degrees between the side of the feed elbow and an outlet side of the feed rotator.

5. The feed arrangement of claim 1, wherein a window is retained upon a corrugation peak of the annular grooves by an iris.

6. The feed arrangement of claim 1, further including a dielectric matching ring seated within the feed bore.

7. The feed arrangement of claim 1, wherein the ortho mode transducer bore is provided with a plurality of inward projecting shoulders that increase a length of the ortho mode transducer bore.

8. The feed arrangement of claim 1, further including at least one radius feature cutaway formed in at least one of the inward projecting shoulder(s) of the feed bore opposite an intersection with the ortho mode transducer bore.

9. A method for manufacturing a feed arrangement, comprising the steps of:

providing a monolithic body with a feed bore between a launch end and a back end of the body;

the feed bore provided with a plurality of inward projecting shoulders that transition the feed bore from a circular cross section at the launch end to a generally rectangular cross-section at the back end;

providing a plurality of coaxial annular grooves on the launch end of the body;

providing an ortho mode transducer bore in the body extending through the body to the feed bore.

10. The method of claim 9, wherein the monolithic body is machined from a metal blank.

11. The method of claim 9, wherein the monolithic body is metal injection molded.

12. The method of claim 9, further including the step of coupling an end cap to the back end of the body; the end cap covering the feed bore.

13. The method of claim 9, further including the step of coupling a feed elbow to the back end of the body; the feed elbow provided with an elbow bore extending from a launch end of the feed elbow to a side of the feed elbow normal to the launch end.

14. The method of claim 13, further including the step of coupling a feed rotator to the side of the elbow, a feed rotator bore of the feed rotator operative to rotate an orientation of the feed rotator bore 90 degrees between the side of the feed elbow and an outlet side of the feed rotator.

15. The method of claim 9, further including the step of coupling a window to a corrugation peak of the annular grooves.

16. The method of claim 15, wherein an iris is placed over the window, coupled to a corrugation peak.

17. The method of claim 9, further including the step of inserting a dielectric matching ring within the feed bore.

18. A microwave antenna feed arrangement, comprising:

a monolithic body with a feed bore between a launch end and a back end of the body;

a plurality of coaxial annular grooves on the launch end of the body, coaxial with the feed bore;

an ortho mode transducer bore in the body extending through the body to the feed bore; the ortho mode transducer bore oriented normal to the feed bore;

a feed elbow coupled to the back end of the body; the feed elbow provided with an elbow bore extending from a launch end of the feed elbow to a side of the feed elbow normal to the launch end;

a feed rotator coupled to the side of the feed elbow, a feed rotator bore of the feed rotator operative to rotate an orientation of the feed rotator bore 90 degrees between the side of the feed elbow and an outlet side of the feed rotator;

a dielectric matching ring seated within the feed bore;

the feed bore is provided with a plurality of inward projecting shoulders that transition the feed bore from a circular cross section at the launch end to a generally rectangular cross section at the back end;

at least one radius feature cutaway formed opposite an intersection with the OMT bore in at least one of the inward projecting shoulder(s) of the feed bore; and the ortho mode transducer bore is provided with a plurality of inward projecting shoulders that increase a length of the ortho mode transducer bore between the feed bore and the side of the body.

* * * * *